US008327951B2

(12) United States Patent
Shamburger et al.

(10) Patent No.: US 8,327,951 B2
(45) Date of Patent: Dec. 11, 2012

(54) DRILL BIT HAVING FUNCTIONAL ARTICULATION TO DRILL BOREHOLES IN EARTH FORMATIONS IN ALL DIRECTIONS

(75) Inventors: James Shamburger, Spring, TX (US); David Wilde, Houston, TX (US)

(73) Assignee: Omni IP Ltd., Road Town, Tortola ( * ) Notice: Subject to any disclaimer, the term of this patent is extended or adjusted under 35 U.S.C. 154(b) by 530 days.

(21) Appl. No.: 12/456,732

(22) Filed: Jun. 22, 2009

(65) Prior Publication Data

US 2009/0321138 A1 Dec. 31, 2009

Related U.S. Application Data

(63) Continuation-in-part of application No. 12/215,435, filed on Jun. 27, 2008, now Pat. No. 7,849,940.

(51) Int. Cl.
*E21B 7/04* (2006.01)

(52) U.S. Cl. ..... 175/61; 175/408

(58) Field of Classification Search ..... 175/61, 175/408, 415, 385

See application file for complete search history.

(56) References Cited

U.S. PATENT DOCUMENTS

| | | | | |
|---|---|---|---|---|
| 5,004,057 | A | 4/1991 | Tibbitts | |
| 5,467,836 | A | 11/1995 | Grimes et al. | |
| 5,740,873 | A | 4/1998 | Tibbitts | |
| 6,123,160 | A | 9/2000 | Tibbitts | |
| 6,206,117 | B1 | 3/2001 | Tibbitts et al. | |
| 6,260,636 | B1 | 7/2001 | Cooley et al. | |
| 6,427,792 | B1 | 8/2002 | Roberts et al. | |
| 6,474,425 | B1 | 11/2002 | Truax et al. | |
| 6,484,825 | B2 | 11/2002 | Watson et al. | |
| 6,659,207 | B2 | 12/2003 | Hoffmaster et al. | |
| 6,684,967 | B2 | 2/2004 | Mensa-Wilmot et al. | |
| 7,287,604 | B2 * | 10/2007 | Aronstam et al. | 175/61 |
| 7,457,734 | B2 | 11/2008 | Johnson et al. | |
| 8,141,657 | B2 * | 3/2012 | Hutton | 175/61 |
| 2002/0020565 | A1 | 2/2002 | Hart et al. | |
| 2005/0273302 | A1 | 12/2005 | Huang et al. | |
| 2006/0037785 | A1 | 2/2006 | Watson et al. | |
| 2007/0205023 | A1 | 9/2007 | Hoffmaster et al. | |
| 2007/0272446 | A1 | 11/2007 | Mensa-Wilmont | |
| 2008/0142271 | A1 | 6/2008 | Brackin et al. | |
| 2009/0044980 | A1 * | 2/2009 | Sheppard et al. | 175/24 |

FOREIGN PATENT DOCUMENTS

| | | |
|---|---|---|
| WO | WO9913194 | 3/1999 |
| WO | WO0043628 | 7/2000 |

* cited by examiner

*Primary Examiner* — Giovanna Wright
(74) *Attorney, Agent, or Firm* — The Matthews Firm

(57) ABSTRACT

A drill bit is described herein, having a first bit face with a first plurality of cutters oriented to bore in a first direction, and a second bit face with a second plurality of cutters oriented to bore in one or more second directions. The pluralities of cutters enable functional articulation of the drill bit, such that the drill bit can change direction within a borehole without requiring removal of the drill bit. The drill bit can thereby drill in a downhole direction and lateral directions, can back ream through the borehole, and can provide the borehole with one or more oversized regions, as desired.

5 Claims, 11 Drawing Sheets

DRILL BIT HAVING FUNCTIONAL ARTICULATION TO DRILL BOREHOLES IN EARTH FORMATIONS IN ALL DIRECTIONS

CROSS-REFERENCE TO RELATED APPLICATIONS

This application is a continuation-in-part application, which claims priority to the United States Patent Application having the application Ser. No. 12/215,435, filed Jun. 27, 2008 now U.S. Pat. No. 7,849,940, entitled DRILL BIT HAVING HAVING THE ABILITY TO DRILL VERTICALLY AND LATERALLY.

FIELD OF THE INVENTION

The present invention relates, generally, to drill bits used for drilling oil and gas wells, and more specifically, to a drill bit capable of drilling in any of a plurality of directions, including backreaming, and drilling oversize boreholes, through a form of functional articulation.

BACKGROUND OF THE INVENTION

Drill bits for drilling a borehole within an earth formation are generally well known in the art. Many conventional drill bits are designed to use cutters that include blades having polycrystalline diamond compact (PDC) cutter elements affixed thereon, mounted on a rotary bit, with the PDC cutter elements arranged such that each engages an earth formation at a desired angle. Drill bits are normally cleaned and cooled during drilling by flowing drilling fluid, or mud, from one or more nozzles on the face of the drill bit. Drilling fluid is pumped down the drill string, flows across the bit face, removing cuttings while cooling the bit, then flows back to the surface through the annulus between the drill string and the borehole wall.

An exemplary drill bit known in the prior art is shown in FIG. 1. Bit 10 is a fixed cutter bit, sometimes referred to as a drag bit or PDC bit, and is adapted for drilling through formations of rock and other earth formations to form a borehole. Bit 10 generally includes a bit body having a shank 13, and a threaded connection or pin 16 for connecting the bit 10 to a drill string (not shown) which is employed to rotate the bit for drilling the borehole. Bit 10 further includes a central axis 11 and a cutting structure on the face 14 of the drill bit, which is shown having a plurality of PDC cutter elements 40 disposed thereon. Also shown in FIG. 1 is a gage pad 12, the outer surface of which is disposed at the diameter of the bit 10 and establishes the bit's size. For example, a 12" bit will have the gage pad approximately 6" from the center of the bit.

FIG. 2 depicts a cross-sectional view of the drill bit of FIG. 1. The bit 10 includes a face region 14 and a gage pad region 12. The face region 14 includes a plurality of blades having cutter elements 40 disposed thereon, overlapping in rotated profile. Rotation of the bit 10 causes the cutter elements 40 to drill the borehole as the bit 10 rotates. Downwardly extending flow passages 21 are shown extending through the body of the bit 10, having nozzles or ports 22 disposed at their lowermost ends. A conventional bit 10 can include six such flow passages 21 and nozzles 22. The flow passages 21 are in fluid communication with a central bore 17. Together, the passages 21 and nozzles 22 serve to distribute drilling fluids around the cutter elements 40 for flushing formation cuttings from the bottom of the borehole and away from the cutting faces of cutter elements 40 when drilling.

While gage pads may be used to provide for a borehole having a predictable and constant diameter, it is advantageous at times, to drill a borehole having one or more oversize, or overgauge, regions. This is especially useful during instances where directional drilling or the drilling of highly deviated wellbores is undertaken, as an overgage hole allows for sharper turns.

Often, to change the gage and/or direction of a borehole, conventional drill bits must be removed from the borehole, reconfigred, and reinserted. Though some drill bits omit use of gage pads and other gage retention mechanisms, or use shortened gage pads combined with dulled or flat cutters to resist wear, these drill bits do not reliably allow for a controlled formation of oversized boreholes and are often limited in their directional drilling capabilities, providing a poor lateral response.

A need exists for a drill bit that has cutting surfaces advantageously oriented to enable one or more regions of a borehole to be controllably provided with regular and oversized diameters.

A further need exists for a drill bit that has cutting surfaces advantageously oriented to enable the drill bit to bore in any selected direction, including lateral directions and back reaming, while downhole, without requiring removal of the bit from the borehole.

The present invention meets these needs.

SUMMARY OF THE INVENTION

The present invention relates, generally, to a drill bit usable to drill a borehole in an earth formation. An embodiment of the invention includes a bit body having an end adapted for connection to a tubular drillstring, such as through use of internal or external threads, or a similar type of secure engagement able to withstand the vibrations inherent in drilling without breaking or loosening. The opposing end of the bit body includes a bit face having a first plurality of cutters disposed thereon. In an embodiment of the invention, the cutters can include blades having cutter elements, such as PDC cutter elements disposed thereon, however other cutter configurations, such as blades or other protrusions having a cutting surface formed directly thereon, or other types of cutter elements affixed thereto, are also usable. The cutting surfaces of the first bit face are oriented to bore through an earth formation in a first direction. Typically, these cutting surfaces are used to bore in a downhole direction, however in various directional drilling operations, these cutting surfaces can be oriented to face any direction. Generally, the first plurality of cutters are usable to bore in a direction opposite the drilling string.

A second bit face is disposed between the ends of the bit body. While the second bit face can be disposed in any relationship with respect to the first bit face, in an embodiment of the invention, the bit body can be a generally cylindrical member, with the first bit face formed along the bottom and the second bit face formed along the lateral surface. The second bit face includes a plurality of cutters disposed thereon, these cutters having cutting surfaces oriented to bore in one or more second directions that differ from the direction in which the first bit face bores when rotated. Together, the first and second pluralities of cutters enable the drill bit to drill in a manner that is functionally similar to articulation. Through this functional articulation, the drill bit can be maneuvered to drill in any direction, while downhole, without requiring removal of the drill bit from the borehole.

For example, the first plurality of cutters can be used to bore in a generally downhole direction, while the second plurality of cutters provide an oversize borehole. Alternatively, the second plurality of cutters can be oriented to bore in a downhole direction, providing the drill bit with an improved rate of penetration. The second plurality of cutters can also be oriented to bore in one or more lateral directions, to backream within the borehole, or combinations thereof.

In an embodiment of the invention, the cutting surfaces of the second plurality of cutters can define the outer circumference of the drill bit. Conventional drill bits have flattened and/or rounded cutter elements, ground to the desired diameter of the borehole to prevent lateral cutting. The present drill bit, however, can present a cutting surface along its outer circumference to enable lateral boring and other changes in drilling direction that would not be possible with a conventional bit.

In a further embodiment of the invention, an outermost portion of a cutter on the second bit face and an innermost portion of a cutter on the first bit face can be angularly displaced from one another by greater than ninety degrees. While conventional drill bits include gage retention mechanisms and other devices to restrict the diameter of the borehole and limit the length of the cutting surface, the present drill bit can include cutters disposed along the shaft of the bit body, providing a cutting radius in excess of ninety degrees. Independent of the angular displacement between cutters, the first and second pluralities of cutters can provide the drill bit with a continuous cutting surface.

The drill bit can also include a wear ring disposed thereon, having a third plurality of cutters set in a plane perpendicular to the longitudinal axis of the drill bit, the third plurality of cutters defining the outermost circumference of the bit. In an embodiment of the invention, each cutter along the wear ring can be spaced no further from the plane than the cutter diameter. One or more additional rings can also be disposed on the drill bit, adjacent to the wear ring, having cutters disposed thereon with a length less than the cutters of the initial wear ring. This configuration enables the wear ring to drill laterally and form a cut in an earth formation, while the cutters on the one or more adjacent rings enlarge the width of the cut.

In operation, embodiments of the present drill bit are usable to change the drilling direction of a borehole. A drill bit, as described previously, having a first plurality of cutters oriented to bore in a first direction, and a second plurality of cutters oriented to bore in one or more second directions, is provided within a borehole. While within the borehole, a lateral force can be exerted proximate to the drill bit, while the drill bit is rotating, to urge the drill bit in a selected direction. The lateral force causes the second plurality of cutters to bore in the selected direction, thereby changing the drilling direction of the drill bit. The lateral force can be exerted using a downhole steerable mud motor, a rotary steerable system, other similar steerable motor systems, or combinations thereof.

Embodiments of the present drill bit are also usable to produce a borehole having one or more downhole regions with a diameter greater than that of one or more preceding regions. A drill bit, as described previously, is provided within a borehole, the drill bit having a first plurality of cutters and a second plurality of cutters vertically displaced from one another. The first plurality of cutters is oriented to bore in a first direction, and the second plurality of cutters is oriented to bore in one or more second directions, the cutters enabling functional articulation of the drill bit within the borehole, as described above.

A first region of the borehole is drilled having a first diameter. A second region of the borehole, located downhole from the first region, can then be drilled while causing functional articulation of the drill bit, causing the second plurality of cutters to provide the second region of the borehole with a greater diameter. The drill bit can then be back reamed through the first region of the borehole without substantially enlarging the diameter of the first region, enabling production of a borehole having an oversized region disposed downhole from a region with a smaller diameter.

Other advantages and features of various embodiments of the present invention shall become apparent from the disclosure below.

DETAILED DESCRIPTION OF THE PREFERRED EMBODIMENTS OF THE INVENTION

Drill bits manufactured and used according to the preferred embodiments of the present invention, being designed to enable functional articulation between the drill bit and the tubular drillstring, are designed to drill in all directions, including forward (downward) in a vertical direction, horizontally, laterally (360°), upward (in a vertical direction,) and at all angels therebetween. This major advance in drill bit technology is accomplished, in part, by using cutters having cutting surfaces set in the flank of the bit, in which the backrake angles of such flank-set cutter ing surfaces each provide a drilling edge via a relief angle produced by the backrake angle.

Figure 3:
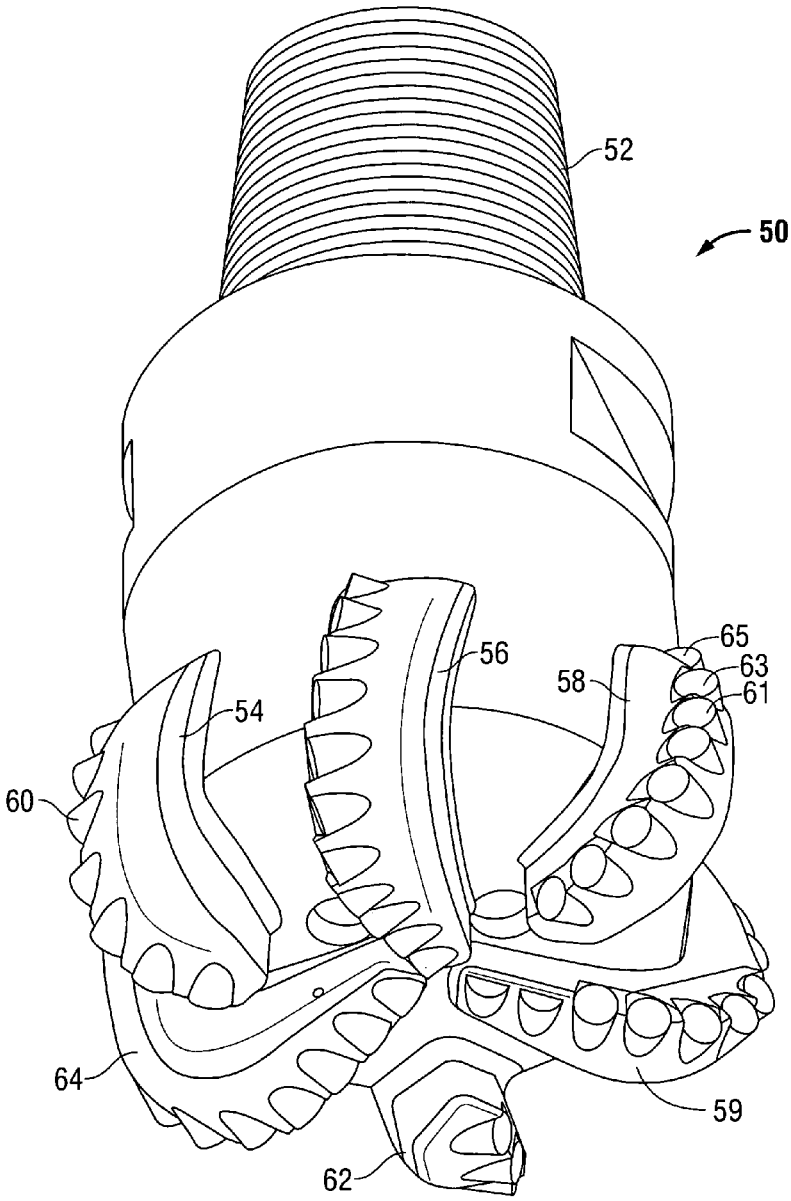
FIG. 3 is a pictorial view of an embodiment of the present drill bit.

FIG. 3 depicts a pictorial view of an embodiment of a drill bit 50 according to the present invention. The drill bit 50 is shown having a threaded pin end 52 for engaging a drill string (not illustrated). The drill bit 50 is further shown having a plurality of blades 54, 56, 58, 59, 62, and 64 disposed thereon, each of the blades having a plurality of cutter elements 60, 61, 63, and 65 disposed thereon.

Figure 4:
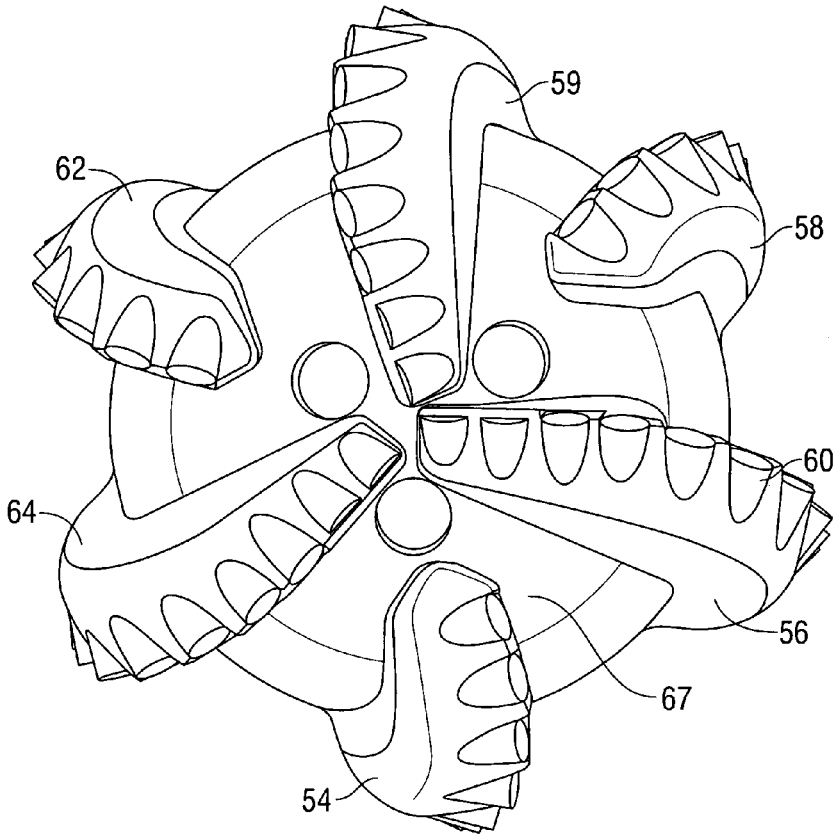
FIG. 4 is a pictorial bottom view of the drill bit of FIG. 3.

FIG. 4 depicts a bottom view of the drill bit of FIG. 3, illustrating the bottom bit face 67. Each of the blades 54, 56, 58, 59, 62, and 64 and the cutter elements, of which cutter element 60 is labeled, are further shown. While FIGS. 3 and 4 depict six blades, it should be understood that the present drill bit can include any number of blades, each containing any number of cutter elements disposed thereon. Further, other configurations of blades with or without cutter elements to define a cutting surface are usable. While FIGS. 3 and 4 depict PDC cutter elements, generally equally spaced from each adjacent PDC cutter element, formed in rows that extend along the blades, it should be understood that any configuration and orientation of cutter elements, independent of blades, and any configuration of blades, independent of cutter elements, can be utilized within the scope of the invention.

Figure 8:
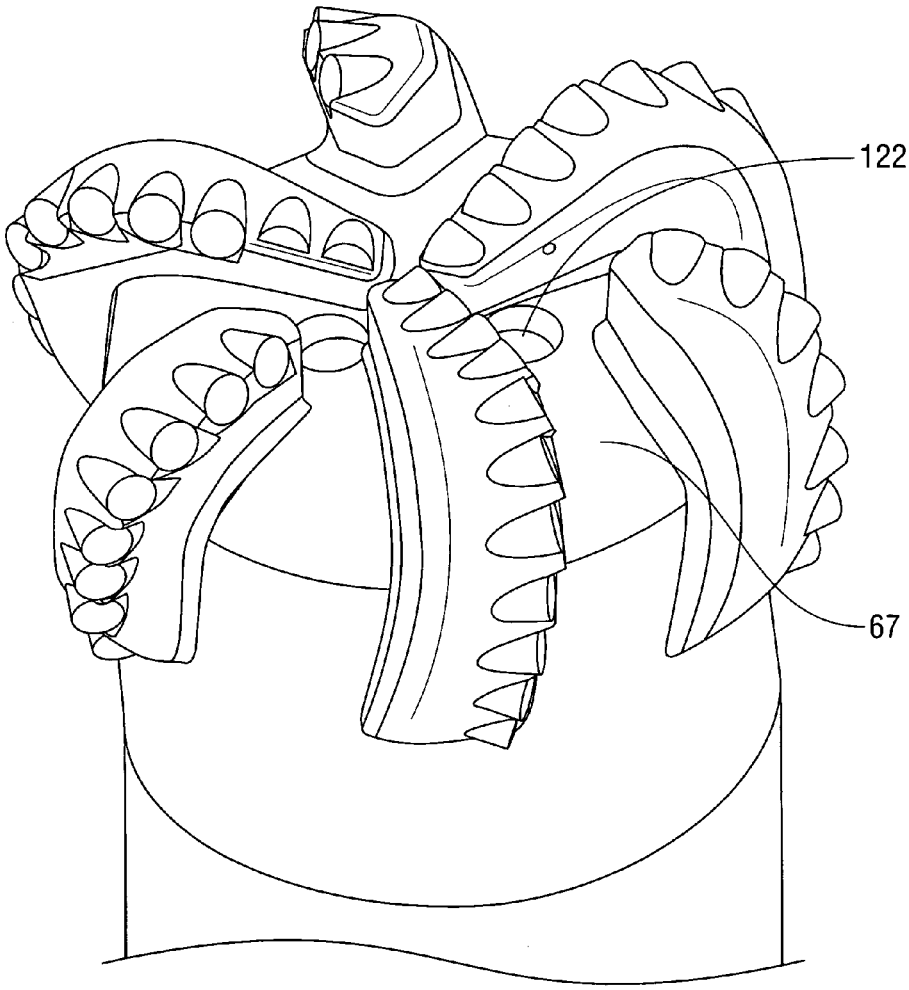
FIG. 8 is an upper pictorial view of the drill bit of FIGS. 3 and 4.

FIG. 8 depicts an upper view of the drill bit of FIGS. 3 and 4, illustrating the bottom bit face 67. In addition to the features of the depicted embodiment of the drill bit, FIG. 8 depicts one or more nozzles 122, used to flow drilling fluid to clean the drill bit and borehole during use.

Figure 1:
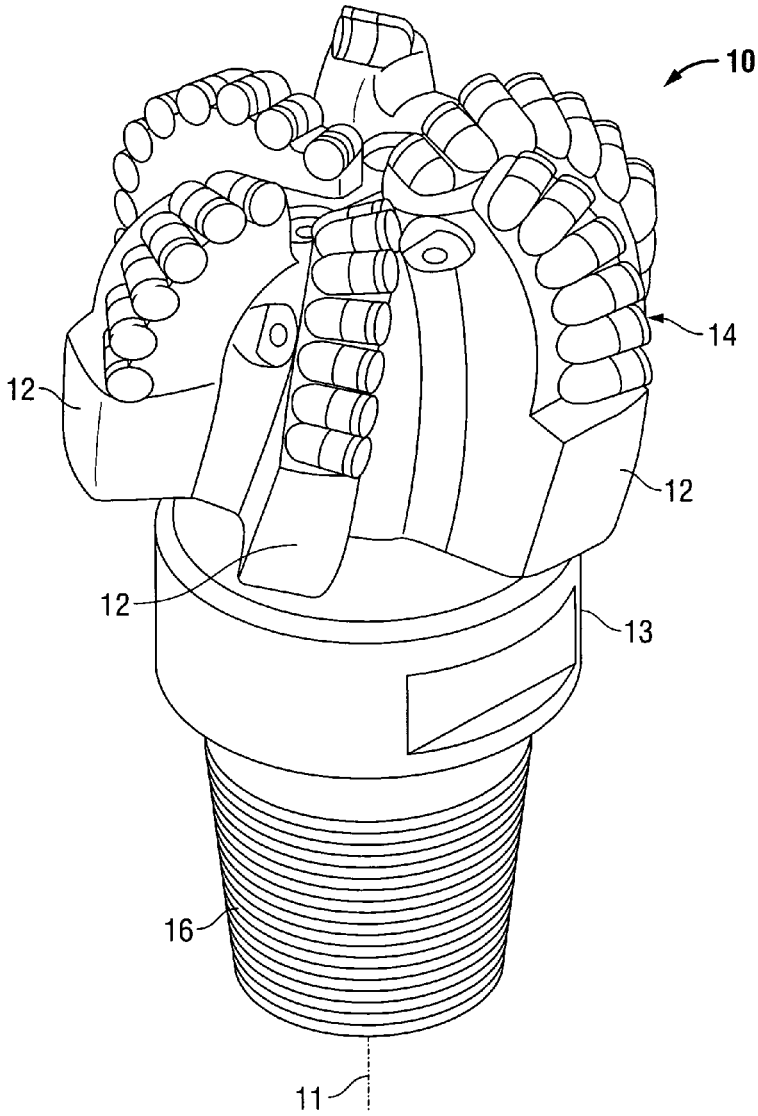
FIG. 1 (Prior Art)
FIG. 1 is a pictorial illustration of a drill bit known in the art.
Figure 2:
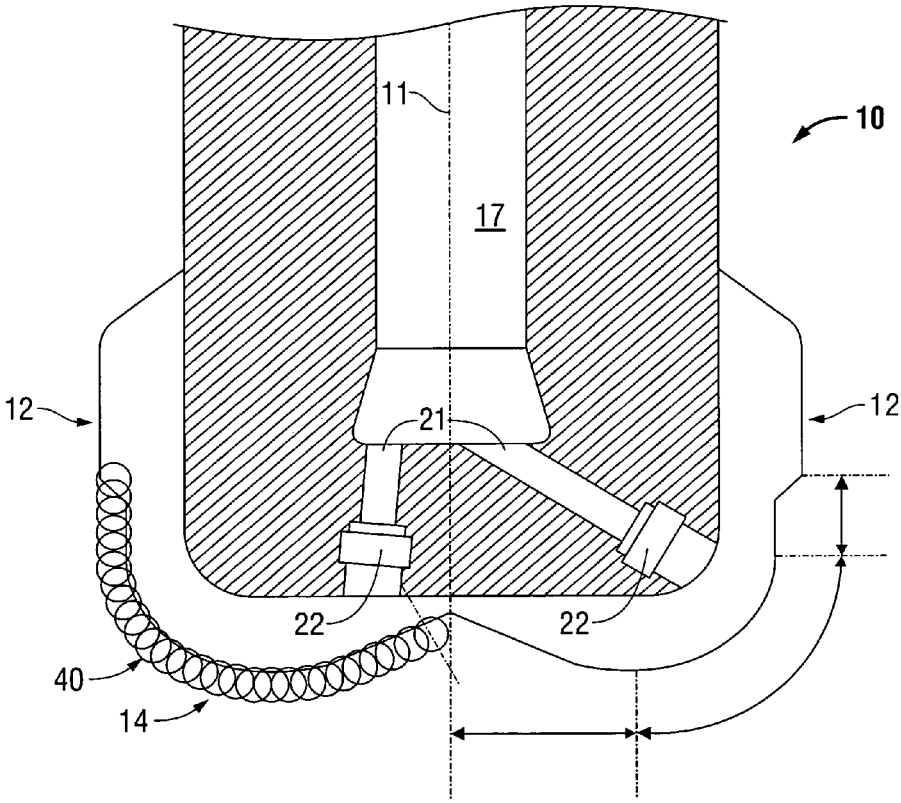
FIG. 2 (Prior Art)
FIG. 2 is a cross-sectional view of the drill bit of FIG. 1.
Figure 5A:
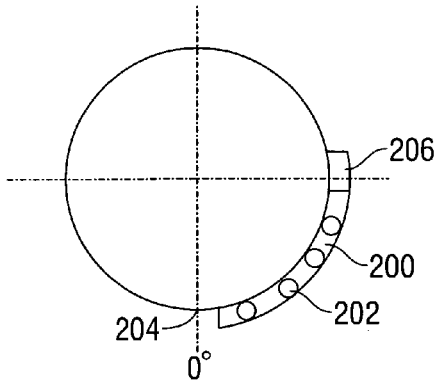
FIG. 5A (Prior Art)
FIG. 5A is a diagram of the orientation of cutter elements disposed along a drill bit known in the art.

FIG. 5A depicts a diagram of the of the orientation of the cutter elements of a drill bit known in the art, such as the drill bit shown in FIGS. 1 and 2. The diagram shows a bottom bit face 204 having a blade 200 disposed thereon. The blade 200 is shown having a plurality of PDC cutter elements 202 disposed thereon. The cutting surface provided by the cutter elements 202 begins proximate to the center of the bottom bit face 204, and extends upward along the side of the bit a short distance, terminating at a wear pad 206, which is angularly disposed approximately ninety degrees from the bottom of the bit face 204. The depicted orientation of the cutter elements 202 and the wear pad 206 restrict the depicted drill bit to drilling a fixed diameter borehole in a generally downhole direction.

Figure 5B:
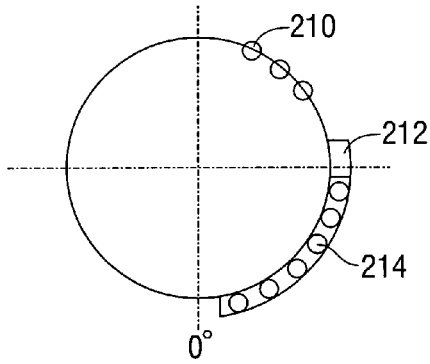
FIG. 5B (Prior Art)
FIG. 5B is a diagram of the orientation of the cutter elements disposed along a second drill bit known in the art.

FIG. 5B depicts a diagram of the of the orientation of the cutter elements of an alternate drill bit known in the art. A plurality of PDC cutter elements 214 are shown, beginning proximate to the center of the bottom bit face and extending upward, to terminate at a wear pad 212 angularly displaced approximately ninety degrees from the bottom of the bit face. The depicted diagram also includes additional PDC cutter elements 210 oriented to back ream within the borehole. Similar to the diagram of FIG. 5A, the depicted orientation of cutter elements 214 and the wear pad 212 enable the drill bit to drill a fixed diameter borehole in a generally downhole direction. The addition of the additional PDC cutter elements 210 enables the drill bit to back ream when pulling the drill bit from the borehole, however only the lower cutter elements 214 are used in the formation of the borehole.

Figure 5C:
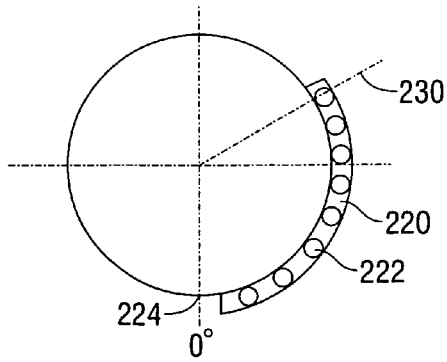
FIG. 5C is a diagram of the orientation of the cutter elements disposed on a cutter of an embodiment of the present drill bit.

FIG. 5C depicts a diagram of the orientation of the cutter elements of an embodiment of the present drill bit. The drill bit is shown having a blade 220 with cutter elements 222 disposed thereon. The cutting surface begins proximate to the center of the bottom bit face 224 and extends upward, along the side of the bit to a selected point 230. While the angular displacement between the selected point 230 and the center of the bit face 224 can vary, in an embodiment of the invention, the outermost portion of the cutting surface can be angularly displaced from the center of the bit face 224 by greater than ninety degrees, and in further embodiments greater than one hundred degrees, and in still further embodiments greater than one hundred fifteen degrees. The depicted arrangement of the cutter elements 222 enables the drill bit to drill not only in a downhole direction, but to also in one or more other directions, including lateral directions, to change the drilling direction of the borehole. The upper cutter elements 222 are also usable to back ream from the borehole. Further, the extended cutting surface enables the depicted drill bit to provide an oversize borehole.

Figure 6:
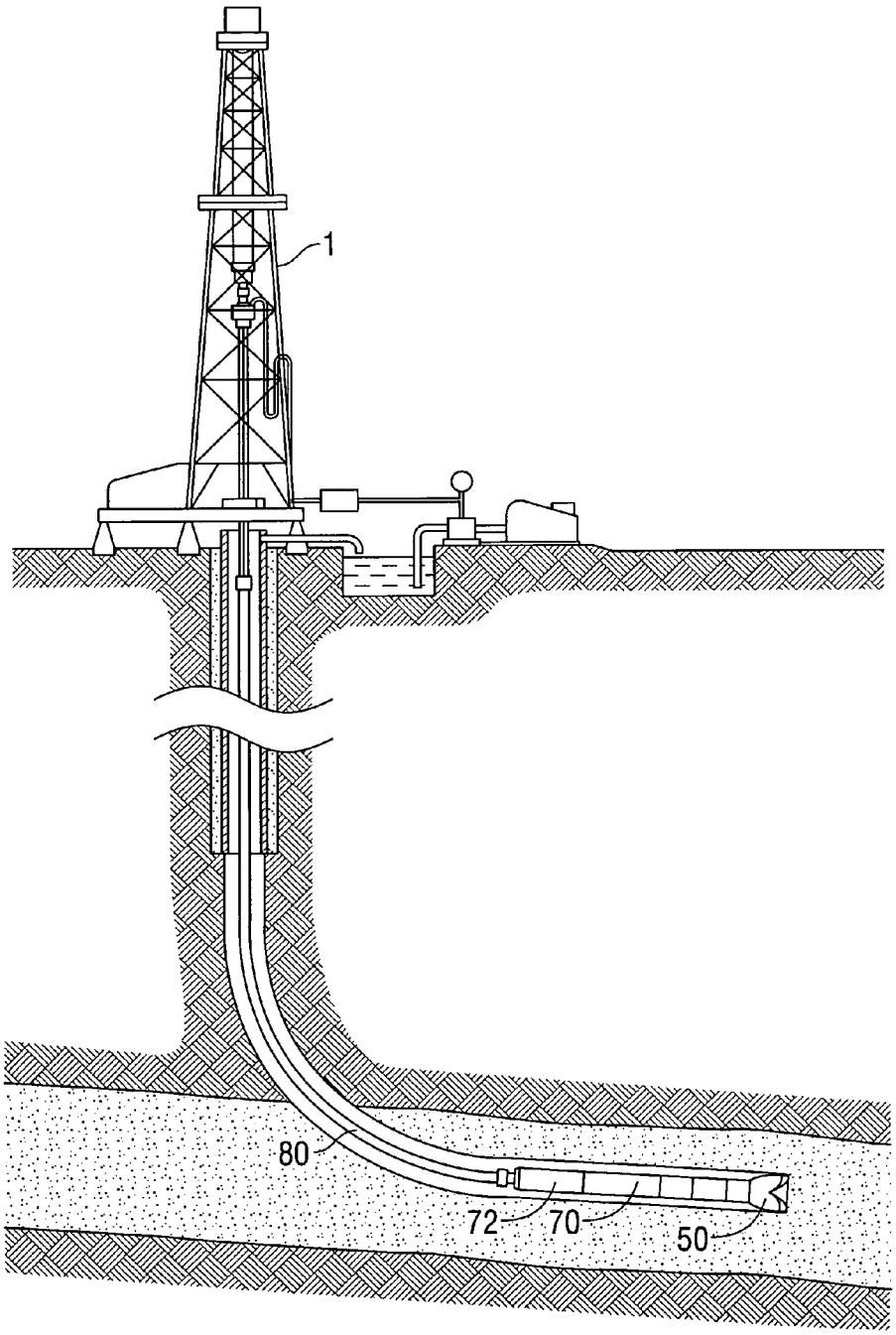
FIG. 6 is a cross-sectional view of a directional wellbore drilled with an embodiment of the present drill bit.

FIG. 6 depicts a cross-sectional view of a directional wellbore able to be drilled using one or more embodiments of the present drill bit. A drill bit 50, as described previously, is shown in communication with a drill string 80, driven by a steerable motor 70 having a "bend" 72, as is known in the art, attached thereto. When drilling a borehole having a large angle, as illustrated in FIG. 6, it can be difficult to run casing past the region of the borehole having this angle. Through use of the a drill bit, such as the embodiments depicted in FIGS. 3 and 4, the outermost cutter elements 63 and 65 can smooth out any rough corners otherwise found in angled regions of a borehole, thereby facilitating the placement of casing.

Two major types of rotary steerable systems are generally known in the art: an orientation system, typically having two bends, which enable the drill string to be rotated to a certain orientation; and a "pusher" system that involves pushing the drill string laterally away from its existing location. Embodiments of the present drill bit may be used to drill laterally in conjunction with a pusher system. Due to the orientation of the cutters, such as the embodiment illustrated in FIG. 3, the drill bit can be caused to drill sideways, in a selected lateral direction, under application of a force. Once the drill bit has been oriented to a proper location by pushing, the pusher phase can be discontinued, and the drill bit can continue to be rotated by the motor to continue drilling in a generally straight direction.

As discussed previously, the drill bit can be pulled up by the drill string and thus act somewhat like a reamer to smooth out, back ream, and/or enlarge the borehole as desired. The use of a pusher rotary steering system, while rotating the drill bit, allows the bit to drill laterally while the drill string is being pushed. This lateral drilling would be inhibited or impossible using a conventional drill bit lacking the cutter configuration described above. It should be appreciated, however, that the present drill is usable with any rotary steerable system known in the art.

For example, in another embodiment of the present invention, the drill bit can drill laterally using a rotary steerable system ("RSS"). The RSS has been introduced in recent years, and is designed to drill directionally, rotating the drill string using a rotary table and/or a top drive, while eliminating the need for a downhole steerable motor. Examples of such RSS services are provided by Sperry-Sun Drilling Services (Halliburton); Weatherford; Schlumberger Oilfield Services; and Baker-Hughes Inteq. A description of such RSS services is provided in the United States Patent Application having the Publication No. US/2007/0251726 A1, assigned to Schlumberger Oilfield Services of Sugar Land, Tex., the entirety of which is incorporated herein by reference. It is also known in this art to provide a combination of the RSS with a downhole mud motor, for example, as described in U.S. Pat. No. 7,298,285, assigned to Schlumberger Technology Corporation in Sugar Land, Tex., which is also incorporated herein by reference.

Figure 9A:
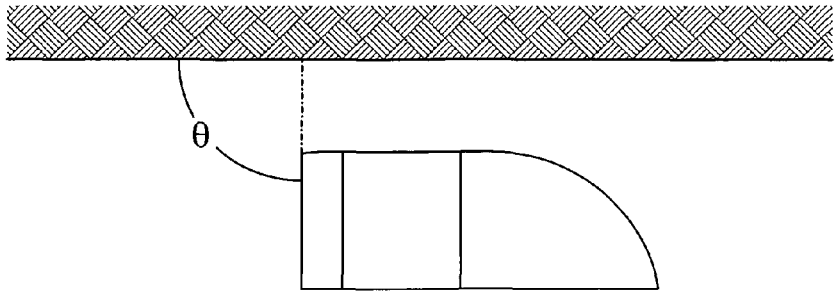
FIGS. 9A-9C are diagrams illustrating backrake angles usable to mount cutters in various embodiments of the present drill bit.
Figure 9B:
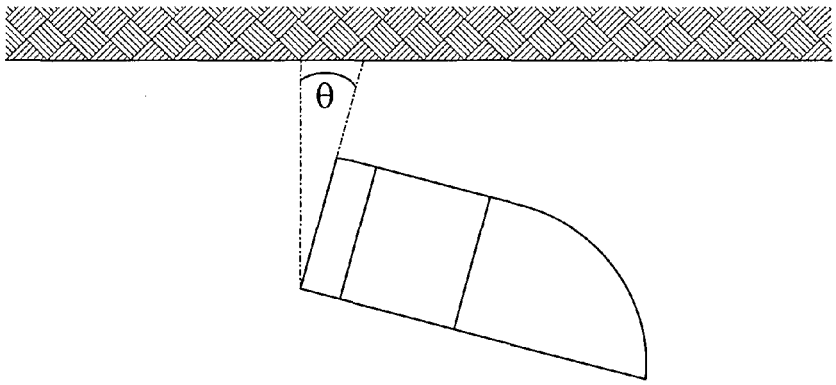
Figure 9C:
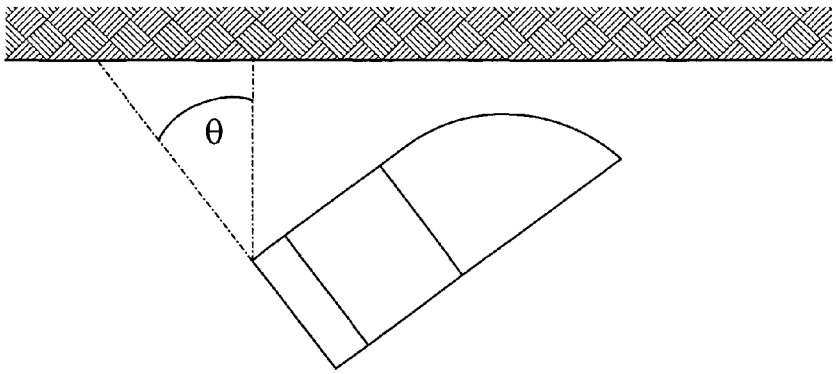

In an embodiment of the invention, the drill bit can have a cutting surface disposed at and near the diameter of the bit, designed to cut laterally into an earth formation. In contrast, conventional drill bits lack such cutters and/or include a gage pad or flattened/ground cutter elements that inhibit the ability to drill laterally into a formation. The cutters mounted at or near the bit diameter enable various backrake and siderake angles. FIGS. 9A, 9B, and 9C, depict a cutter element with cutting surface, and diagrams of various backrake angles. FIG. 9A depicts a zero degree backrake, i.e. along a line perpendicular to the formation wall. FIG. 9B illustrates a negative twenty degree backrake. FIG. 9C illustrates a positive twenty degree backrake.

The backrake angles chosen for a given drill bit can be determined based on the geology of the formation being drilled and/or the desired aggressive attack angle. A typical "normal" backrake for drilling can include a negative backrake range of −10° to −30°, but can also include a range between +15° to −35°.

A low backrake provides an aggressive attack angle, and thus accelerates the lateral cutting action. A high backrake provides a reduced attack angle, with a reduced lateral efficiency, but increases the durability of the drill bit. Varying the backrake angle thereby provides for "tuning" of the present drill bit.

Figure 10A:
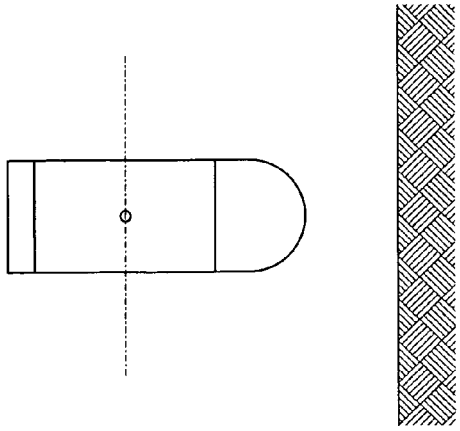
FIGS. 10A-10C are diagrams illustrating siderake angles usable to mount cutters in various embodiments of the present drill bit.
Figure 10B:
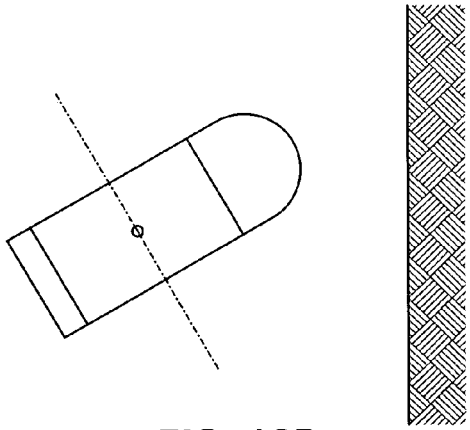
Figure 10C:
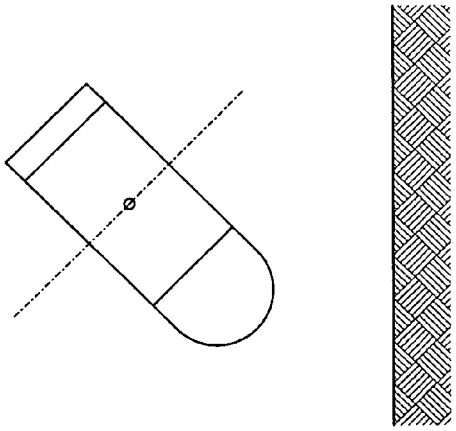

In addition to the backrake considerations, FIGS. 10A, 10B, and 10C, illustrate various embodiments of siderale angles of cutter elements mounted at or near the gage diameter of the bit. A negative siderake angle produces a lifting force, when engaging the borehole wall, whereas a positive siderake angle produces a downward force, when engaging the borehole wall, in the direction towards the bit face which is preferred in many directional drilling situations.

More specifically, FIGS. 10A-10C depict a cutter element with a body, cutting edge, and an outer edge oriented to penetrate the borehole wall. FIG. 10A depicts a PDC cutter element having a zero degree siderake. FIGS. 10B and 10C show a PDC cutter element having a positive and negative siderake angles, caused by the cutter being rotated.

In an embodiment of the invention, the drill bit can can use siderake angles ranging from negative twenty five degrees to positive twenty five degrees.

Figure 11:
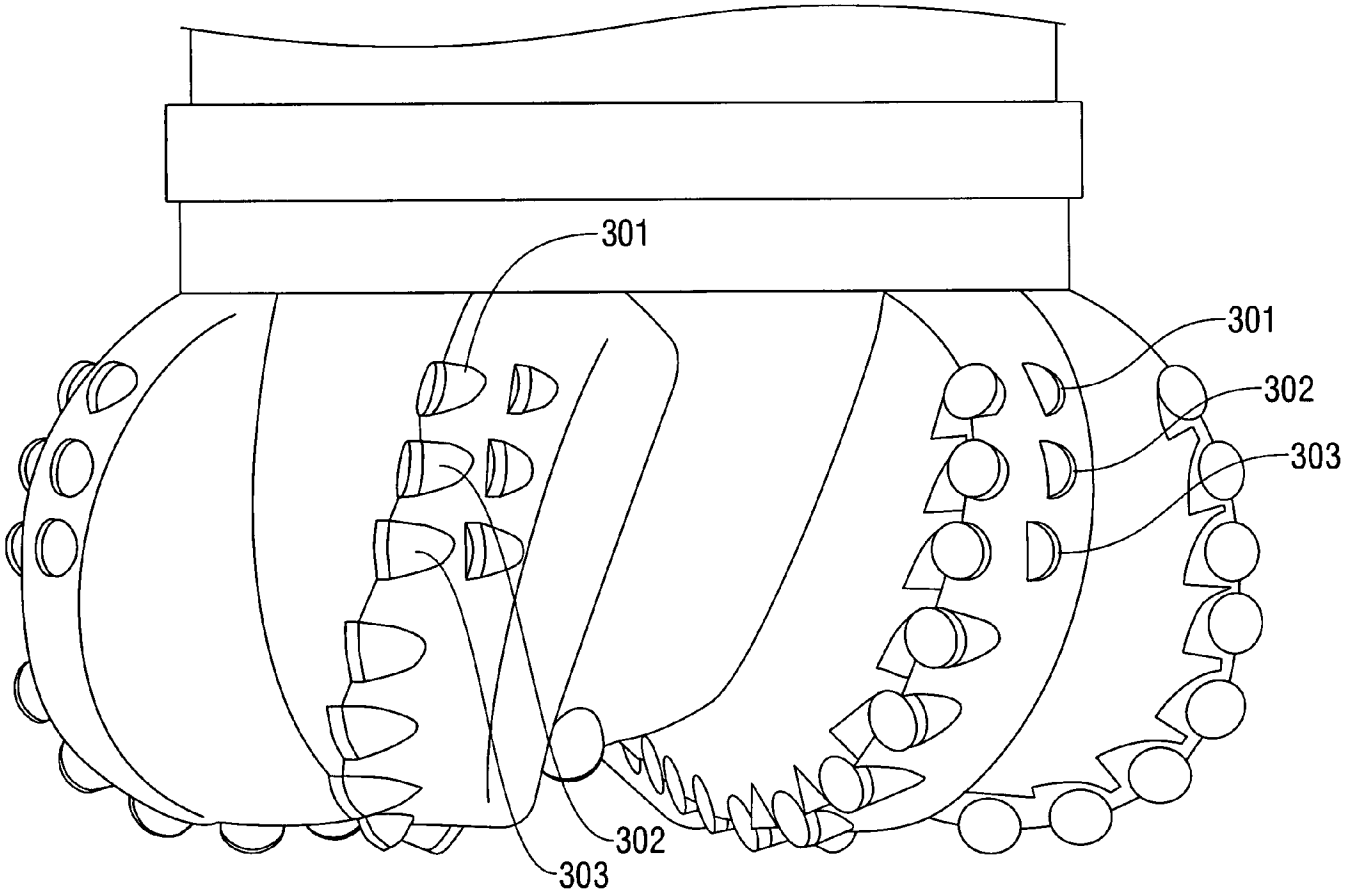
FIG. 11 is a pictorial view of another embodiment of the present drill bit.

FIG. 11 illustrates an alternative embodiment of the present drill bit in which each of the cutters includes a blade having one or more twin sets of PDC cutter elements disposed thereon. The depicted drill bit is of particular use in abrasive formations or in extended drilling applications. Although the depicted bit is illustrated with each blade having only three paired sets of PDC cutter elements 301, 302, 303, it should be appreciated that any number and any combinations and configurations of cutter elements, independent of blades, and/or blades, independent of cutter elements, can be used as necessary.

Figure 7:
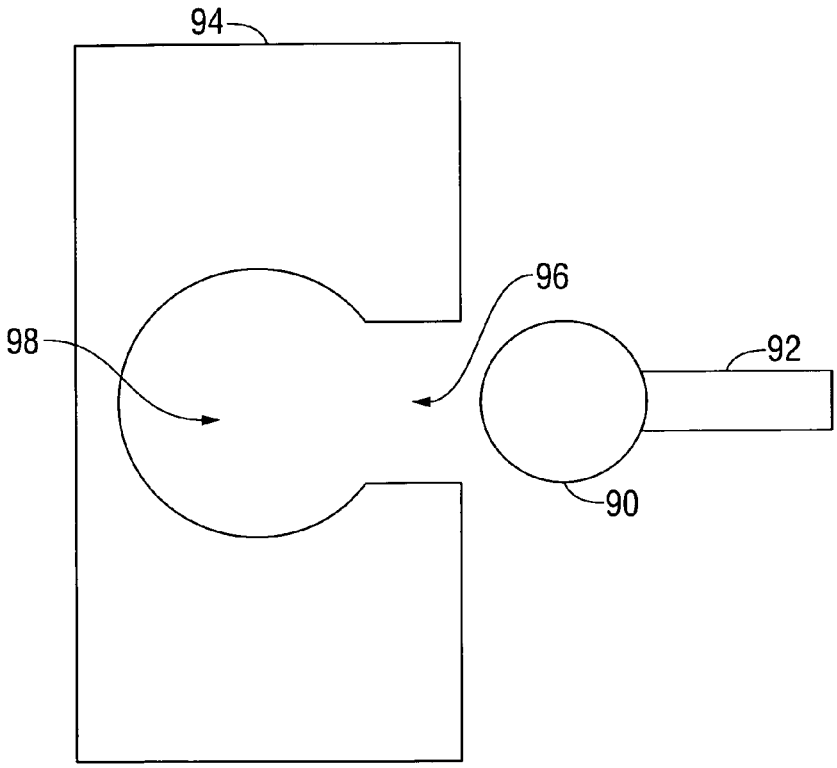
FIG. 7 is a diagram illustrating the cutting of an external reentrant profile.

Embodiments of the present drill bit can also provide an externally reentrant profile, whereby the drill bit can function similarly, in some respects, to a round or ball end mill used for machining purposes. The principle of external reentrant profiling is illustrated in FIG. 7, in which a solid block of concrete or other drillable material is penetrated by a round or ball end mill 90 having a driving stem 92, which first penetrates the concrete block 94 creating an entrance portal 96. Once the round ball end mill 90 reaches the central region of the concrete block 94, the stem 92 can be moved to form the rounded out opening 98. This is all accomplished by the fact that the mill 90 can cut out any portion of the concrete against which it is moved by the rotation of the stem 92. This use is analogous to the present drill bit, which can be used to cut into any section of the side wall of a borehole and thus enlarge various regions of the borehole without enlarging other regions.

The invention claimed is:

1. A method for drilling a borehole having at least one downhole region with a diameter greater than the diameter of at least one preceding region, the method comprising the steps of:

providing a drill bit comprising a first plurality of cutters and a second plurality of cutters vertically displaced from the first plurality of cutters, wherein the first plurality of cutters comprise cutting surfaces oriented to bore in a first direction, wherein the second plurality of cutters comprise cutting surfaces oriented to bore in at least one second direction, and wherein the first and second pluralities of cutters enable functional articulation of the drill bit within the borehole, such that the direction of drilling can be changed without withdrawing the drill bit from the borehole;

drilling a first region of the borehole having a first diameter; and drilling a second region of the borehole while functionally articulating the drill bit to provide the second region of the borehole with a second diameter greater than the first diameter, wherein the second region of the borehole is located downwell from the first region of the borehole.

2. The method of claim 1, further comprising the step of back reaming the drill bit through the first region without enlarging the first diameter.

3. The method of claim 1, wherein the first and second pluralities of cutters define at least one continuous cutting surface, and wherein the step of drilling the second region of the borehole while functionally articulating the drill bit causes at least a portion of the at least one continuous cutting surface to drill toward at least a portion of the interior circumference of the borehole.

4. A method for drilling a borehole having at least one downhole region with a diameter greater than the diameter of at least one preceding region, the method comprising the steps of:

providing a drill bit comprising a first plurality of cutters and a second plurality of cutters vertically displaced from the first plurality of cutters, wherein the first plurality of cutters comprise cutting surfaces oriented to bore in a first direction, wherein the second plurality of cutters comprise cutting surfaces oriented to bore in at least one second direction, and wherein the first and second pluralities of cutters enable functional articulation of the drill bit within the borehole, such that the direction of drilling can be changed without withdrawing the drill bit from the borehole;

drilling a first region of the borehole having a first diameter;

drilling a second region of the borehole while functionally articulating the drill bit to provide the second region of the borehole with a second diameter greater than the first diameter; and back reaming the drill bit through the first region without enlarging the first diameter.

5. A method for drilling a borehole having at least one downhole region with a diameter greater than the diameter of at least one preceding region, the method comprising the steps of:

providing a drill bit comprising a first plurality of cutters and a second plurality of cutters vertically displaced from the first plurality of cutters, wherein the first plurality of cutters comprise cutting surfaces oriented to bore in a first direction, wherein the second plurality of cutters comprise cutting surfaces oriented to bore in at least one second direction, and wherein the first and second pluralities of cutters enable functional articulation of the drill bit within the borehole, such that the direction of drilling can be changed without withdrawing the drill bit from the borehole;

drilling a first region of the borehole having a first diameter; and drilling a second region of the borehole while functionally articulating the drill bit to provide the second region of the borehole with a second diameter greater than the first diameter, wherein the first and second pluralities of cutters define at least one continuous cutting surface, and wherein the step of drilling the second region of the borehole while functionally articulating the drill bit causes at least a portion of the at least one continuous cutting surface to drill toward at least a portion of the interior circumference of the borehole.

* * * * *